US005495653A

United States Patent [19]

Schrock et al.

[11] Patent Number: 5,495,653

[45] Date of Patent: Mar. 5, 1996

[54] APPARATUS AND METHOD FOR DISPLAYING AND DISPENSING CHAIN OR THE LIKE

[75] Inventors: Lester N. Schrock, St. Charles; Richard George, Winona, both of Minn.

[73] Assignee: Peerless Chain Company, Winona, Minn.

[21] Appl. No.: 285,631

[22] Filed: Aug. 1, 1994

[51] Int. Cl.[6] ..... B21K 21/16; A47F 5/00

[52] U.S. Cl. ..... 29/401.1; 29/434; 29/462; 211/175; 211/184; 242/594.1; 242/594.4; 206/394

[58] Field of Search ..... 211/175, 184; 29/401.1, 434, 462; 108/55.1, 55.3; 242/594.1, 594.2, 594.3, 594.4, 594.5, 594.6; 206/388, 394

[56] References Cited

U.S. PATENT DOCUMENTS

| | | | |
|---|---|---|---|
| 4,896,778 | 1/1990 | Ferdinand et al. | 211/175 |
| 5,143,230 | 9/1992 | LaCorte | 242/594.5 |
| 5,148,927 | 9/1992 | Gebka | 211/184 |
| 5,293,998 | 3/1994 | George | 206/388 |
| 5,318,190 | 6/1994 | Mason | 211/175 |

*Primary Examiner*—David P. Bryant

*Attorney, Agent, or Firm*—Merchant, Gould, Smith, Edell, Welter & Schmidt

[57] ABSTRACT

The present invention relates to a display apparatus and method for displaying and dispensing elongated product such as chain. The present invention includes identical side plates interconnected by two V-shaped members which are in turn telescopically interconnected to each other so as to provide for variable adjustment of the length of the display apparatus.

6 Claims, 4 Drawing Sheets

APPARATUS AND METHOD FOR DISPLAYING AND DISPENSING CHAIN OR THE LIKE

BACKGROUND OF THE INVENTION

The present invention relates to an apparatus and method for displaying and dispensing chain or the like.

Conventional retail store displays for displaying elongated product such as chain, which is typically stored on reels, are often unsightly and requires substantial maintenance. The present invention solves many of the problems associated with existing apparatus and methods for displaying and dispensing chain or the like.

SUMMARY OF THE INVENTION

The present invention relates to an apparatus and method for displaying and dispensing chain or the like.

An advantage of a preferred embodiment of the present invention is that it can be used with existing store fixtures and shelves. A preferred embodiment of the present invention can be used with standard 36–48 inch shelf units.

Yet another advantage of a preferred embodiment of the present invention is that it provides modular capability and flexibility. The present invention because of flexibility permits a display including a single shelf or multiple shelves, variable length shelves, and variable width shelves.

A preferred embodiment of the present invention facilitates restocking of the display since the reels holding the chain can be individually removed and restocked. Accordingly it is easier to keep the display looking neat and fully stocked.

In a preferred embodiment of the present invention a hydraulic chain cutter is mounted with the display.

Another advantage of a preferred embodiment of the present invention is the provision of shelf surfaces for displaying point of sale and other information.

In a preferred embodiment of the present invention, reels of varying widths and diameters can be used.

An advantage of a preferred embodiment of the present invention is that it uses an identical side plate for either side of the display such that the side plates are interchangeable.

Yet another advantage of a preferred embodiment of the present invention is that it is telescopically adjustable to different lengths. Accordingly, the length of the display is readily adjusted and only the space required is used.

A preferred embodiment of the present invention is wide enough to provide for storage of extra reels behind a front row of reels.

In a preferred embodiment, the display is attached to a shelf by a few threaded fasteners and in particular, in one preferred embodiment, only the side plates are threadedly fastened to the shelf.

These and various other advantages and features of novelty which characterize the invention are pointed out with particularity in the claims annexed hereto and forming a part hereof. However, for a better understanding of the invention, its advantages, and the objects obtained by its use, reference should be made to the accompanying drawings and descriptive matter, which form a further part hereof, and in which there is illustrated and described a preferred embodiment of the invention.

BRIEF DESCRIPTION OF THE DRAWINGS

In the drawings wherein like reference numerals indicate corresponding parts throughout the several views.

DETAILED DESCRIPTION OF THE PREFERRED EMBODIMENT

Figure 1:
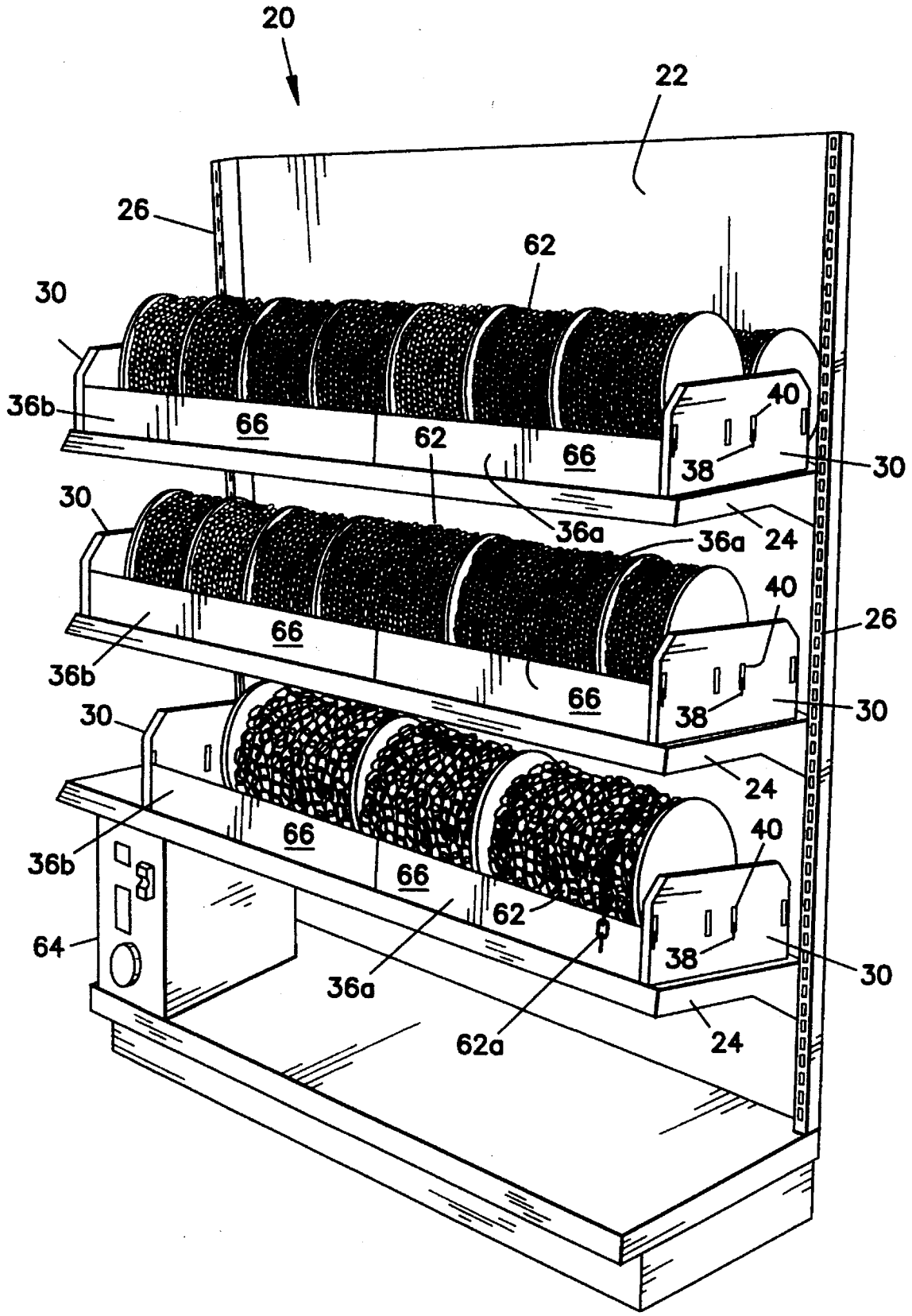
FIG. 1 is a perspective view of a preferred embodiment of a display apparatus in accordance with the principles of the present invention.

Referring now to the drawings there is shown in FIGS. 1–7 a preferred embodiment of a display apparatus 20 in accordance with the principles of the present invention. The preferred embodiment of the present invention is configured and arranged to be used with standard store fixtures. As shown in FIG. 1, the standard store fixture includes a vertical riser 22 with one or more flat shelves 24 which are vertically supported by spaced apart vertically extending support members 26 which provide for vertical adjustment of the shelves 24.

Figure 2:
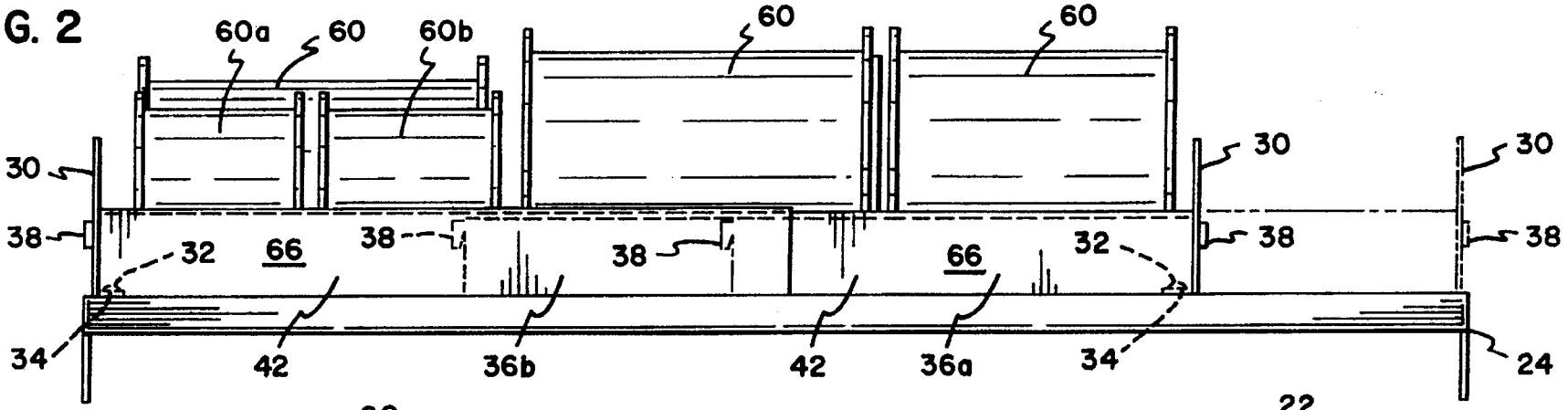
FIG. 2 is a front elevational view of a single shelf of the display apparatus shown in FIG. 1, the shelf being shown in phantom line in an extended configuration.
Figure 3:
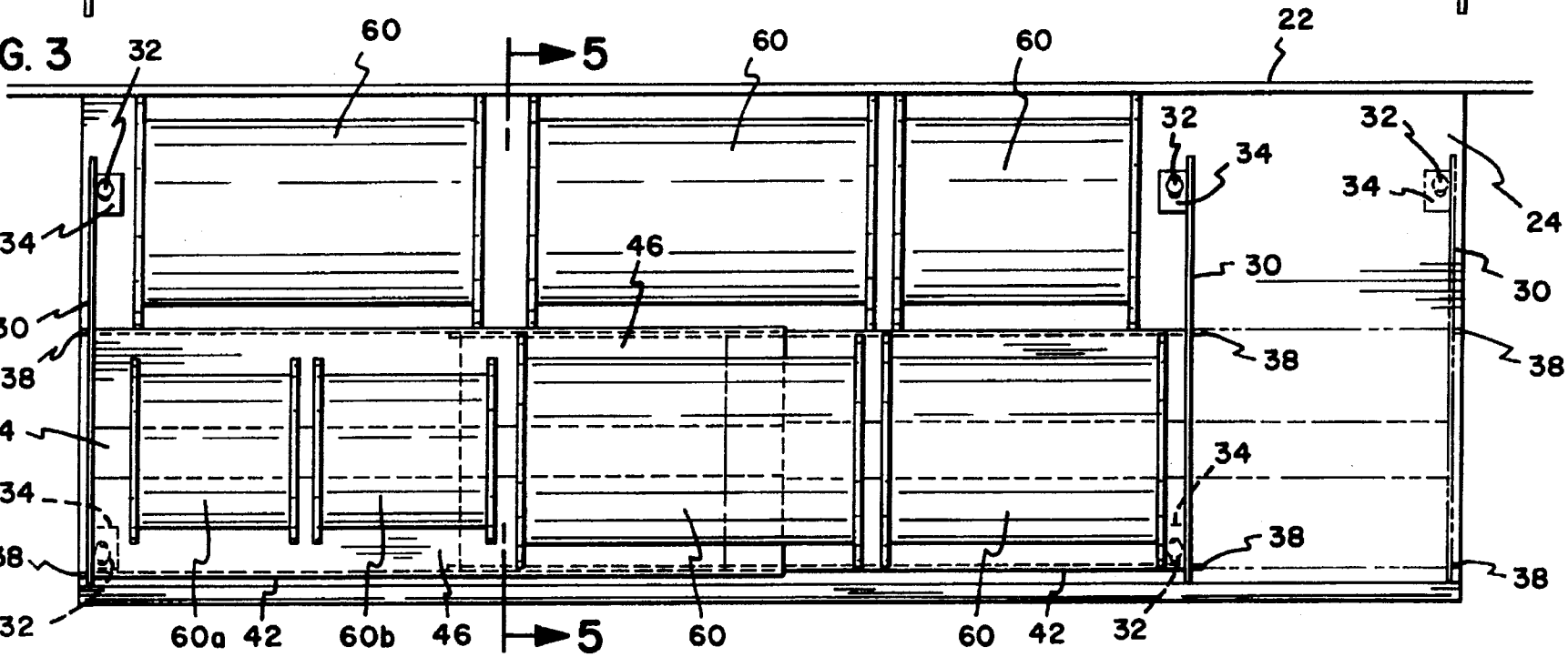
FIG. 3 is top view of the shelf shown in FIG. 2.

The preferred embodiment of the present invention includes two identical side plates 30 which are attached to opposite ends of each of the shelves 24 by threaded fasteners 32 inserted through apertures disposed in horizontally extending tabs 34 and threaded into the shelf 24 as generally shown in FIGS. 2 and 3. In the preferred embodiment, the apertures are disposed so as to be in alignment with existing apertures in the shelves; e.g., apertures in sixteen inch shelving. The side plates 30 are interconnected by two generally V shaped members 36 which are telescopically interconnected to allow for ready adjustment of the length of the display apparatus to fit the length of the shelves 24. A first V-shaped member **36*a* is telescopically received in a second V-shaped member 36*b***.

In FIGS. 2 and 3, phantom lines illustrate the display apparatus in an extended configuration. It will be appreciated that the length of the display apparatus is readily adjusted by unfastening one of the side plates 30 and pushing the opposing side plates together whereby the first V-shaped member is pushed further into the second V-shaped member or pulling the opposing side plates away from each other whereby the first V-shaped member is pulled further out of the second V-shaped member. The side plate 30 is then fastened to the shelf 24. The preferred embodiment can be adjusted to fit standard thirtysix to fortyeight inch shelf lengths.

Figure 4:
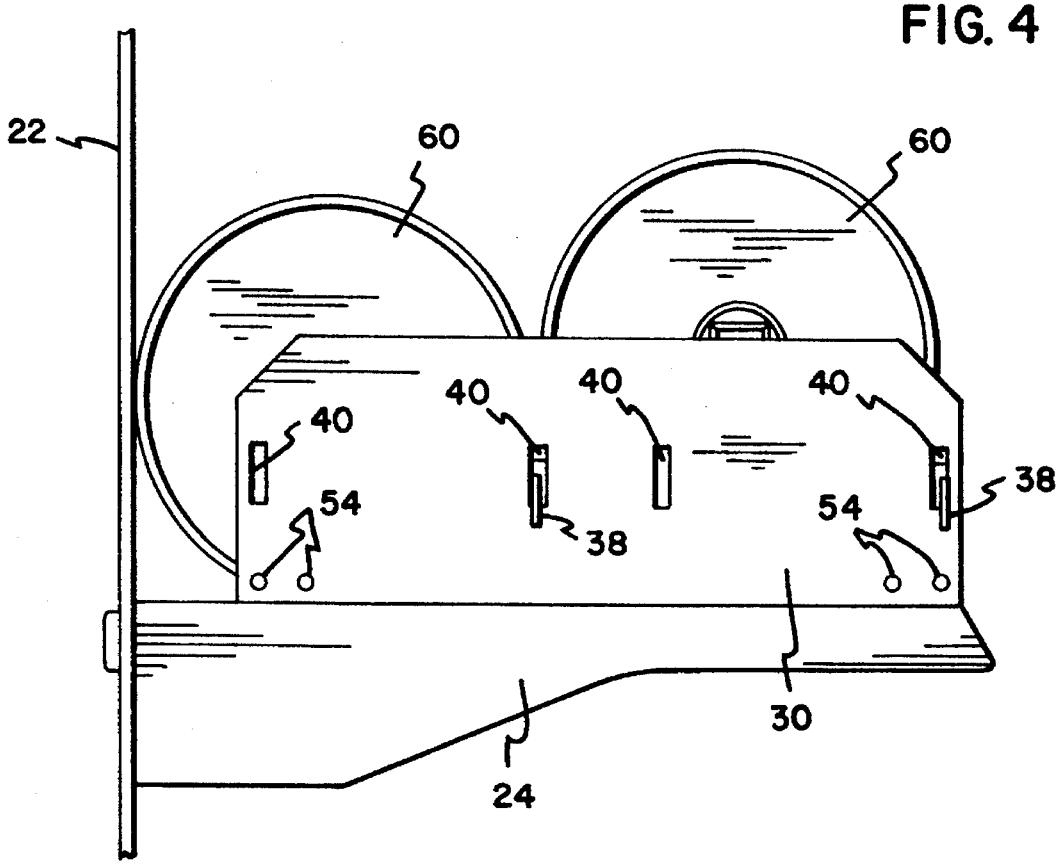
FIG. 4 is a side view of the shelf shown in FIG. 2.

The V-shaped members 36 are attached to the side plates 30 by inserting projections 38 on the V-shaped members into apertures 40 on the side plates 30. No threaded fasteners or other fastening devices are required to attach the V-shaped members 36 to the side plates 30. FIG. 4 is a side view illustrating attachment of the V-shaped member 36 to the side plate member 30 by two spaced apart projections 38 at each end of the V-shaped member 36.

Figure 5:
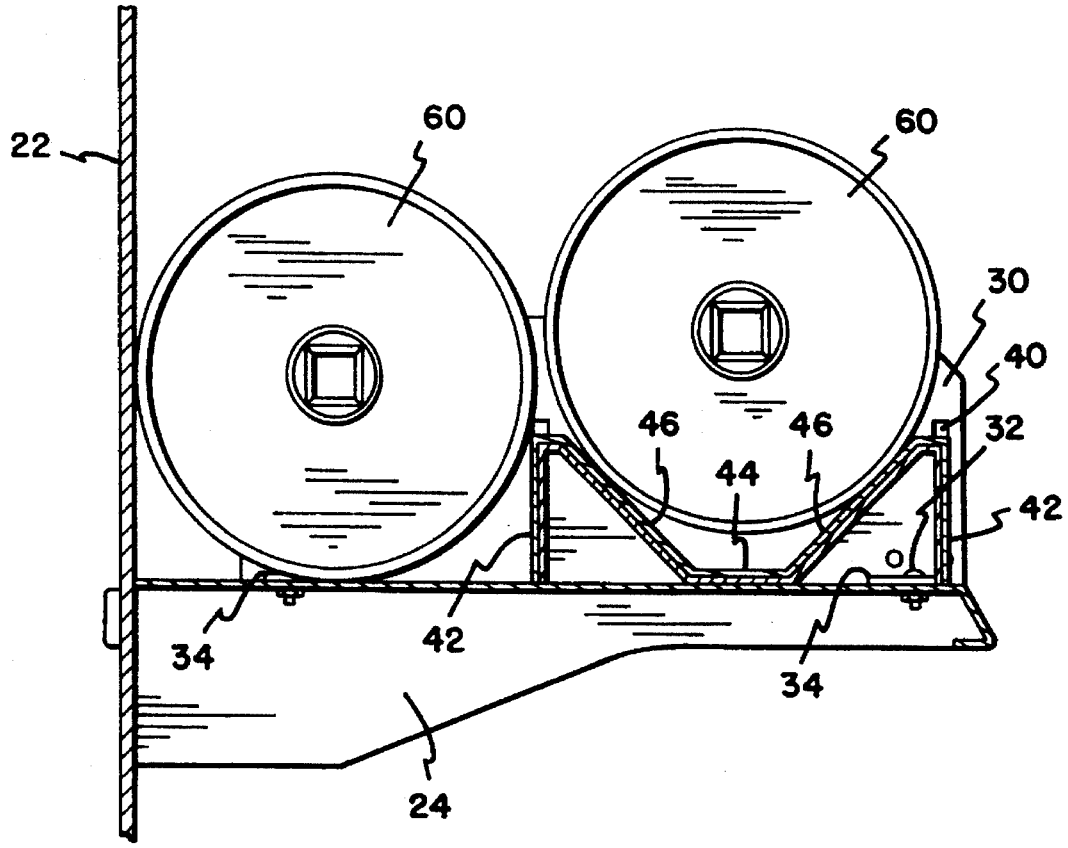
FIG. 5 is a sectional view as seen generally along line 5—5 of FIG. 3.

FIG. 5 illustrates a cross section of the V-shaped members 36*a,b*. As shown, the V-shaped member 36*a* extends into the V-shaped member 36*b*. In the embodiment shown, the V-shaped members 36*a,b* slidably engage each other. The V-shaped members 36*a,b* have two spaced apart vertical walls 42 and a central, bottom horizontal wall 44 interconnected to the two vertical walls 42 by two diagonal walls 46. In a preferred embodiment the V-shaped members 36*a* have a height of 2.85 inches and a width of 8.36 inches and the V-shaped members 36*b* have a height of 2.88 inches and a width of 8.63 inches. The V-shaped member 36*a* in the preferred embodiment might have a length of 25.94 inches while the V-shaped member 36*b* might have a length of 24.2 inches.

In the preferred embodiment the V-shaped members 36 and the side plates are made of twentyfour gauge steel.

Figure 6:
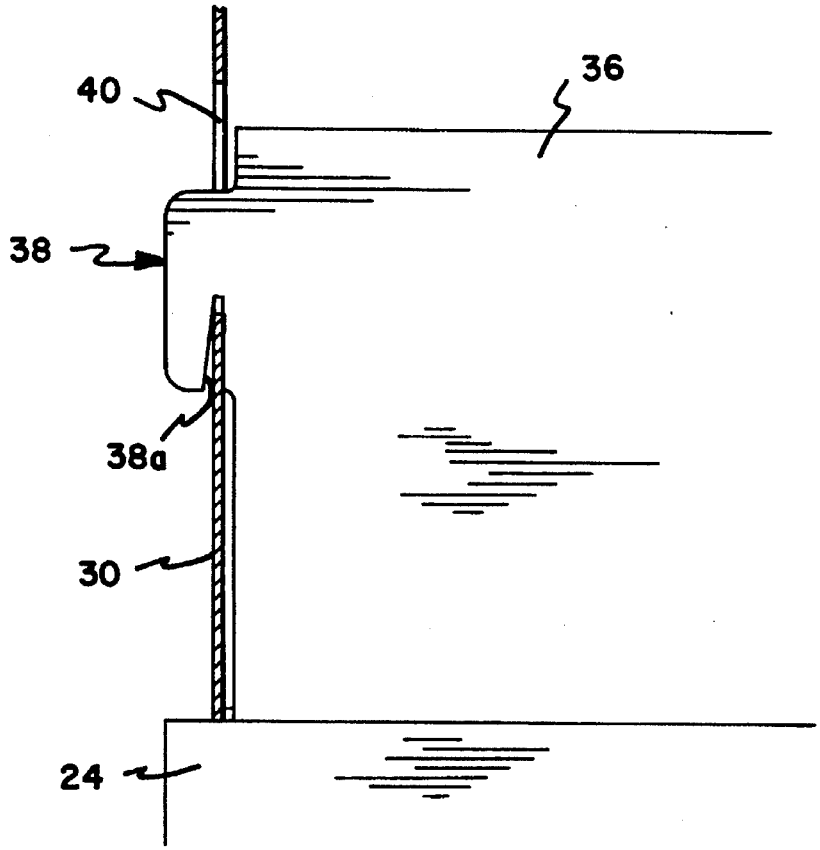
FIG. 6 is a partial sectional view illustrating attachment of a front plate to a side plate of the display apparatus.

FIG. 6 is a detailed view of the projection 38. As shown the projection 38 defines a gap between a side of the V-shaped member 36 and the projection 38. The projection 38 has an inclined surface 38*a* which cooperates with the side of the V-shaped member 3,5 to form a gap at a five degree angle which is increasingly narrower as it extends upward. In the preferred embodiment, the gap at its narrowest point is of lesser extent than the width of the side plate 30. Accordingly, the side plate 30 is wedged into the gap formed between the projection 38 and the side of the V-shaped member 36 by forcing down on the V-shaped member 36 after insertion of the projection 38 through the aperture 40. Accordingly, the V-shaped members 36 are securely retained in place without the use of any fasteners.

Moreover, as illustrated in FIG. 2, the V-shaped member 36*a* has the projections 38 on each side. Accordingly it is possible to use only the V-shaped member 36*a* to form a display apparatus. The V-shaped member 36*b* has the projections 38 only on one side.

Figure 7:
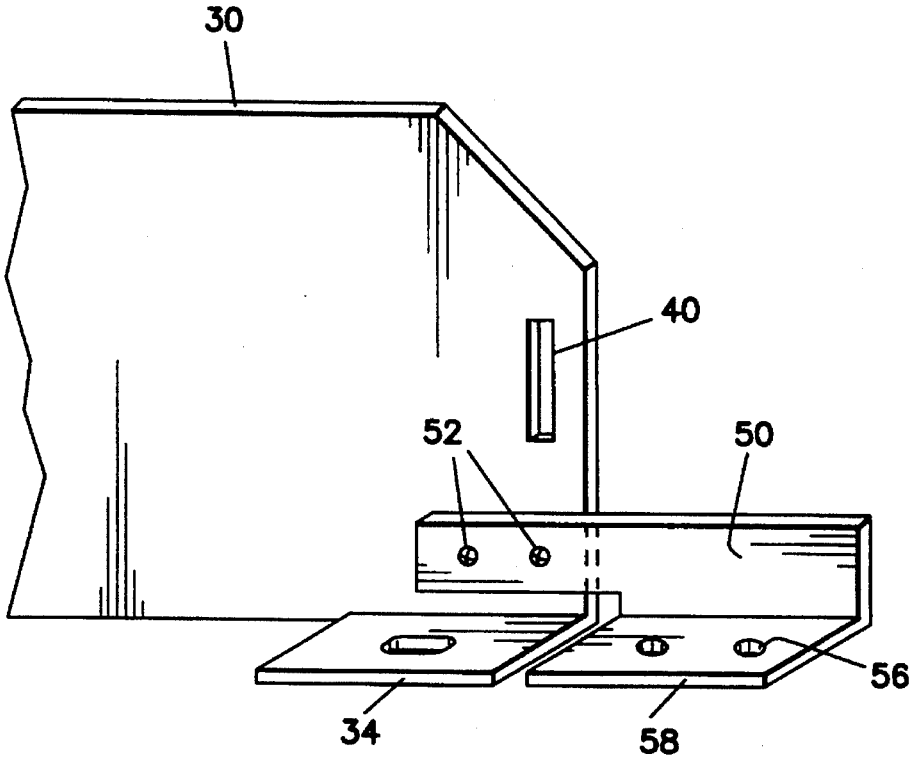
FIG. 7 is a partial perspective view illustrating attachment of an extension to a side plate.

As illustrated in FIG. 7, a side extension member 50 might be attached to the side plates 30 to increase the width of the display apparatus. In the embodiment shown, the side extension member 50 is attached by fasteners 52 inserted into apertures 54 defined proximate a bottom portion of the side plates 30. The side extension member 50 is in turn fastened to the shelf by inserting fastener members (not shown) through apertures 56 in a horizontally extending tab 58 of the side extension member 50. This allows the width of the display apparatus to be readily increased. For example, the normal configuration and sizing of the display apparatus might be for sixteen inch shelves. The side extension member 50 allows use of the display apparatus on eighteen to twentyfour inch shelves.

The display apparatus of the present invention preferably allows two rows of reels 60 holding chain 62 or other elongated product such as rope to be stored on each shelf. As shown in FIGS. 2 and 3, the reels might be of varying width and length. For example, as shown in FIG. 2, reels 60*a,b* have a smaller diameter and length than the other reels 60. In the preferred embodiment the reels might have a diameter which varies from five to nine inches. The front row of reels 60 preferably contains chain for dispensing while the second row of reels 60 are spare reels which can be used to replace those in the front row as they run out of chain.

The chain 62 is dispensed from the reels 60 by simply pulling on an end of chain, as represented by 62*a*. As the end of chain on a specific reel is pulled, the reel rotates in the V-shaped member 36 thereby allowing the chain 62 to be removed or withdrawn from the reel 60. The reels 60 rotate independently of each other so it is relatively easy to withdraw the chain.

As shown in FIG. 1, a chain cutter mechanism 64 might be mounted in conjunction with the display apparatus. Accordingly, after removing a desired length of chain from the reel, the chain can be cut and the remaining chain wound back up on the reel as desired.

As illustrated in FIG. 1, the V-shaped members 36 including a front surface 66 for displaying point of sale information and the like. In a preferred embodiment, the front surface might have a height of roughly three inches.

Having read the foregoing description, it is to be understood, that even though numerous characteristics and advantages of various embodiments in accordance with the principles of the invention have been set forth in the foregoing description, together with details of the structure and function of the invention, the disclosure is illustrative only, and changes may be made in detail, especially in matters of shape, size, and arrangement of the parts within the principles of the invention to the full extent indicated by the broad general meaning of the terms in which the appended claims are expressed.

What is claimed is:

1. A display apparatus including:

an upright support member;

a horizontally extending shelf member, said shelf member being attached to said support member;

two identical side plates, the side plates being attached to the shelf member, each of the side plates including spaced apart apertures;

two generally V-shaped members interconnecting the side plates, a first one of the V-shaped members being telescopically received in a second one of the V-shaped members, the V-shaped members including projections which are engageably receivable in the apertures of the side plates; and a plurality of reels having elongated product wound thereon being disposed on the V-shaped members, the reels being independently supported by the V-shaped members thereby enabling each of the reels to rotate independently of the other reels.

2. An apparatus in accordance with claim 1, wherein the projections of the V-shaped members define a gap of decreasing width in a direction toward a top portion of the V-shaped member.

3. A display apparatus kit, including:

two identical side plates having bottom tabs with apertures for receiving fasteners; and two V-shaped members connectable to the side plates by insertion of projections on the V-shaped members through openings in the side plates, a first one of the V-shaped members telescopically received in a second one of the V-shaped members whereby the spacing between the side plates can be readily adjusted.

4. A method of making a display dispensing apparatus for chain utilizing an existing shelf, the method comprising the steps of:

telescopically interconnecting two V-shaped members to one another so as to form a V-shaped support;

attaching the V-shaped support to two side plates at opposite sides of the V-shaped support by inserting projections on the V-shaped members into apertures in the side plates;

fastening the side plates to the shelf; and positioning reels containing chain product on the V-shaped support.

5. A method in accordance with claim 4, wherein said side plates include preformed holes therein which align with preformed apertures in the shelf, and said fastening step comprises inserting fasteners through said preformed holes and into said preformed apertures in said shelf.

6. A display apparatus including:

a pair of spaced apart side plates, each of the side plates including apertures;

two telescopically engageable, generally V-shaped members including projections, the V-shaped members being connectable to the side plates by insertion of the projections on the V-shaped members through the apertures in the side plates.

* * * * *